US008040939B2

(12) United States Patent
Kim et al.

(10) Patent No.: US 8,040,939 B2
(45) Date of Patent: Oct. 18, 2011

(54) PICTURE MODE CONTROLLER FOR FLAT PANEL DISPLAY AND FLAT PANEL DISPLAY DEVICE INCLUDING THE SAME

(75) Inventors: Jin Sung Kim, Gyeongbuk (KR); Min Ki Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 963 days.

(21) Appl. No.: 11/819,682

(22) Filed: Jun. 28, 2007

(65) Prior Publication Data

US 2008/0129761 A1 Jun. 5, 2008

(30) Foreign Application Priority Data

Nov. 30, 2006 (KR) ..... 10-2006-0119911

(51) Int. Cl.
*G09G 5/00* (2006.01)

(52) U.S. Cl. ..... 375/213; 345/92; 345/98; 345/204

(58) Field of Classification Search ..... 345/87–103, 345/204, 690–693, 698, 699, 211–213
See application file for complete search history.

(56) References Cited

U.S. PATENT DOCUMENTS 5,731,798 A * 3/1998 Shin ..... 345/99
5,966,119 A * 10/1999 Hwang ..... 345/213
6,020,879 A * 2/2000 Nakabayashi ..... 345/212
6,046,737 A * 4/2000 Nakamura ..... 345/213
6,362,805 B1 * 3/2002 Jeong ..... 345/99
7,057,610 B2 * 6/2006 Kataoka et al. ..... 345/211
7,352,352 B2 * 4/2008 Oh et al. ..... 345/102
2002/0140662 A1 * 10/2002 Igarashi ..... 345/98
2003/0085860 A1 * 5/2003 Baek ..... 345/87
2003/0142058 A1 * 7/2003 Maghielse ..... 345/98
2004/0125061 A1 * 7/2004 Furukoshi ..... 345/87
2006/0208999 A1 * 9/2006 Lee et al. ..... 345/102
2007/0205998 A1 * 9/2007 Lee et al. ..... 345/204

FOREIGN PATENT DOCUMENTS

EP 0707301 * 4/1996
JP 2006-166188 * 6/2006

* cited by examiner

*Primary Examiner* — Lun-Yi Lao
*Assistant Examiner* — Kelly B Hegarty
(74) *Attorney, Agent, or Firm* — Morgan, Lewis & Bockius LLP

(57) ABSTRACT

The picture mode controller for flat panel and flat panel display device including the same includes an input unit to input a first timing signal indicating transmission sections for pixel data, and a second timing signal indicating a transmission time of each pixel data, a pseudo timing signal generating unit to generate a first pseudo timing signal to be used as the first timing signal, a first selecting unit to selectively output the first timing signal and the first pseudo timing signal to allow one of a video picture mode and a black picture mode to be designated, and a selection control unit to control a selecting operation of the first selecting unit based on whether the first timing signal is input from the input unit and whether a period of the second timing signal changes.

18 Claims, 6 Drawing Sheets

PICTURE MODE CONTROLLER FOR FLAT PANEL DISPLAY AND FLAT PANEL DISPLAY DEVICE INCLUDING THE SAME

This application claims the benefit of the Korean Patent Application No. 10-2006-0119911 filed on Nov. 30, 2006, which is hereby incorporated by reference.

BACKGROUND OF THE INVENTION

1. Field of the Invention

The present invention relates to a flat panel display device for displaying an image on a flat panel, and more particularly, to a picture mode controller for selecting one of a video image and a black image on a flat panel, a flat panel display device including the same, and a driving method thereof.

2. Discussion of the Related Art

Flat panel displays such as general liquid crystal panels, plasma display panels, and electro luminescence display panels include pixels formed in respective unit regions defined by scan lines (gate lines) and data lines (source lines). A flat panel display can provide a large screen while having a remarkably thin thickness compared to a cathode ray tube (CRT). Furthermore, flat panel displays make it possible to manufacture image display devices having a slim profile and light weight.

Video data corresponding to an image to be displayed on these flat panel displays are supplied in the form of a pixel data stream to the flat panel display device from a video source including a graphic card of a computer system, and a video demodulating unit of a television receiver. Timing signals including data clock and data enable signals are transmitted together with the video data. These timing signals indicate the period of pixel data and the section where pixel data are present to allow the flat panel display device to accurately receive video data.

During an initial booting when a video source has not been initialized, a portion of timing signals are not generated for a predetermined time and another portion of timing signals are generated in a state (i.e., an abnormal state) wherein the timing signals do not coincide with timings of the video data. During the initial booting, data enabling signals are not generated while data clock is generated in a state (i.e., an abnormal state) where the period of the data clock does not coincide with the timing of video data. When a portion of timing signals are absent, a flat panel display device cannot accurately receive video data. Accordingly, an abnormal image totally different from an original image is inevitably displayed on a flat panel.

Also, when the resolution mode of an image to be displayed on a flat panel changes, timing signals temporarily have an abnormal form that does not coincide with video data. Both data enable signals and data clock do not coincide with the timing of video data temporarily. Due to these abnormal timing signals, a flat panel display device cannot accurately receive video data. Accordingly, an abnormal image totally different from an original image is inevitably displayed on a flat panel.

Furthermore, timing signals transmitted together with video data can be interfered and distorted by noises while they are transmitted from a video source to a flat panel display device. Due to this distortion, the flat panel display device cannot accurately receive video data. Accordingly, an abnormal image totally different from an original image may be displayed on the flat panel display.

To prevent an abnormal image from being displayed, a method of displaying a black image has been used in a related art flat panel display device. According to the method of displaying the black image, receiving video data and driving a liquid crystal (LC) panel are performed based on a received data enable signal or a pseudo enable signal depending on whether the data enable signal is present among timing signals from a video source. In other words, when a data enable signal is received, an image is displayed based on the received data enable signal. On the other hand, when the data enable signal is not received, a black image is displayed based on a pseudo enable signal.

However, since a video image and a black image are selectively displayed depending on whether a predetermined timing signal is present, an abnormal image is still displayed on a flat panel display when the resolution mode of an image changes. In addition, when timing signals (particularly, data enable signals) are distorted due to noises, an abnormal image is displayed on a flat panel display. The abnormal image greatly reduces the reliability of a flat panel display device.

SUMMARY OF THE INVENTION

Accordingly, the present invention is directed to a picture mode controller for flat panel and flat panel display device including the same that substantially obviates one or more problems due to limitations and disadvantages of the related art.

An object of the present invention is to provide a picture mode controller capable of improving reliability of a flat panel display device.

Another object of the present invention is to provide a flat panel display device and a driving method thereof, capable of preventing an abnormal image from being displayed.

Another object of the present invention is to provide a flat panel display device and a driving method thereof, capable of displaying a normal image even when timing signals are distorted.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the picture mode controller for flat panel and flat panel display device including the same includes an input unit to input a first timing signal indicating transmission sections for pixel data, and a second timing signal indicating a transmission time of each pixel data, a pseudo timing signal generating unit to generate a first pseudo timing signal to be used as the first timing signal, a first selecting unit to selectively output the first timing signal and the first pseudo timing signal to allow one of a video picture mode and a black picture mode to be designated, and a selection control unit to control a selecting operation of the first selecting unit based on whether the first timing signal is input from the input unit and whether a period of the second timing signal changes.

In another aspect, the flat panel display device includes a flat panel, an input unit to input a pixel data stream, a first timing signal indicating transmission sections for pixel data, and a second timing signal indicating a transmission time of each pixel data, a driving circuit to drive the flat panel using the pixel data stream, the first timing signal, and the second timing signal to display an image corresponding to the pixel data stream, a pseudo timing signal generating unit to generate a pseudo timing signal corresponding to the first timing signal, a selecting unit to selectively supply the first timing signal from the input unit and the pseudo timing signal to the driving circuit to selectively display a video image corresponding to a video data stream and a black image on the flat panel, and a selection control unit to control a selecting operation of the selecting unit based on whether the first timing signal is input from the input unit and whether a period of the second timing signal changes.

In another aspect, the method for driving a flat panel display device having a flat panel, an input unit to input a pixel data stream, a first timing signal indicating transmission sections for pixel data, and a second timing signal indicating a transmission time of each pixel data, a driving circuit to drive the flat panel using the pixel data stream, the first timing signal, and the second timing signal to display an image corresponding to the pixel data stream, and a pseudo timing signal generating unit to generate a pseudo timing signal corresponding to the first timing signal includes detecting whether the first timing signal is received from the input unit, detecting whether a period of the second timing signal from the input unit changes, and selectively supplying the first timing signal and the pseudo timing signal to the driving circuit depending on whether the first timing signal is received and the period of the second timing signal changes, and selectively displaying a video image corresponding to a video data stream and a black image on the flat panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
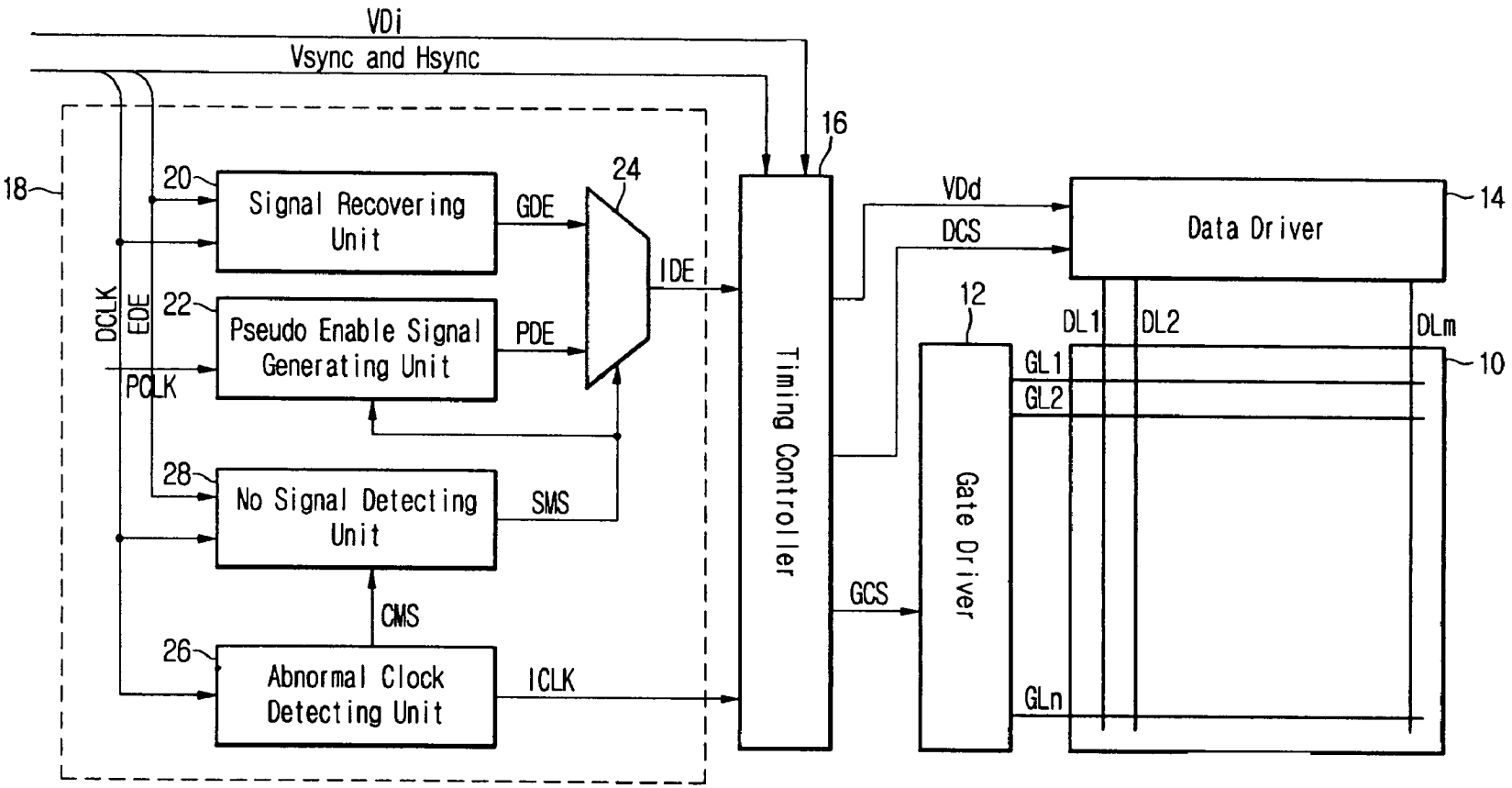
FIG. 1 is a block diagram of a liquid crystal display (LCD) device including a picture mode controller according to an exemplary embodiment of the present invention.

FIG. 1 is a block diagram of an LCD device including a picture mode controller according to an exemplary embodiment of the present invention. Though the LCD device illustrated in FIG. 1 is described as an embodiment of the present invention, it would be obvious to a person of ordinary skill in the art that various modifications can be made without departing from the spirit and scope of the present invention. For example, the present invention can be applied to a plasma display device and an electric field light-emitting display device.

As shown in FIG. 1, the LCD device includes a gate driver 12 connected to a plurality of gate lines GL1-GLn on an liquid crystal LC panel 10, and a data driver 14 connected to a plurality of data lines DL1-DLm on the LC panel 10. The plurality of gate lines GL1-GLn and data lines DL1-DLm, formed on the LC panel 10, cross each other and define a plurality of pixel regions. A pixel is formed at each of the pixel regions.

Each pixel on the LC panel 10 includes a thin film transistor (TFT) (not shown) connected in series between a corresponding data line DL and a common voltage line (not shown), and an LC cell (not shown). The TFT switches a pixel driving signal to be supplied from the corresponding data line DL to a corresponding LC cell in response to a scan signal on a corresponding gate line GL. When the TFT is turned on, the corresponding LC cell is charged with the pixel driving signal from the corresponding DL. The LC cell maintains the pixel driving signal until the TFT is turned on again. The LC cell controls light transmittance according to an electric potential difference between the pixel driving signal and the common voltage and displays an image on the LC panel 10.

The gate driver 12 sequentially enables the plurality of gate lines GL1-GLn for a predetermined time. For example, the predetermined time, i.e., one frame, may be a time of one horizontal synchronization signal. For this purpose, the gate driver 12 generates a plurality of scan signals mutually and exclusively having gate enable pulses sequentially shifted by a period of a horizontal synchronization signal. The gate enable pulse, in each of the plurality of scan signals, has the same width as the time of the horizontal synchronization signal. The gate enable pulse, in each of the plurality of scan signals, is sequentially generated in every frame period. To generate the plurality of scan signals, the gate driver 12 responds to gate control signals GCS from a timing controller 16. The gate control signals GCS include at least a gate start pulse and a gate clock. The gate start pulse has a pulse of a predetermined logic (e.g., a high logic) or a constant logic corresponding to the duration of one horizontal synchronization signal from a starting point of a frame period. The gate clock has the same period as that of the horizontal synchronization signal. The gate control signals can include at least two gate clocks. The two gate clocks have a phase difference corresponding to the period of the horizontal synchronization signal.

The data driver 14 generates pixel driving signals corresponding to the number of the data lines DL1-DLm, i.e., the number of pixels arranged on one gate line, whenever one of the plurality of gate lines GL1-GLn is enabled. Each of the pixel driving signals corresponding to one gate line is supplied to a corresponding pixel, i.e., a LC cell, on the LC panel 10 through the data line corresponding to the pixel. To generate the pixel driving signals corresponding to one gate line, the data driver 14 sequentially inputs pixel data corresponding to the one gate line by the period of an enable pulse contained in the scan signal. The data driver 14 converts the pixel data corresponding to the one gate line into analog pixel driving signals. The data driver 14 responds to data control signals DCS from the timing controller 16 in order to input pixel data and output pixel driving signals.

To control the gate driver 12 and the data driver 14, the timing controller 16 responds to timing signals from an external video data source (not shown). For example, the external video data source may be an image signal demodulator of a television receiver or a graphic card of a computer system.

Timing signals supplied from the external video data source include a data enable signal EDE, a data clock DCLK, a horizontal synchronization signal Hsync, and a vertical synchronization signal Vsync. The timing controller 16 generates gate control signals GCS using timing signals that are required for the gate driver 12 to generate the plurality of scan signals for sequentially scanning the plurality of gate lines GL1-GLn on the LC panel 10 every frame. Also, the timing controller 16 generates data control signals DCS required for the data driver 12 to sequentially input pixel data corresponding to one gate line by a period when the gate line GL is enabled, to convert the sequentially input pixel data corresponding to the one gate line into analog pixel driving signals, and output the analog pixel driving signals. Thereafter, the timing controller 16 receives pixel data streams VDi divided by a frame unit (one image unit) from the video data source. The timing controller 16 divides the pixel data streams VDi into pixel data VDd by an amount of one horizontal line and supplies the divided pixel data VDd corresponding to an amount of the one horizontal line to the data driver 14.

The LCD device of FIG. 1 includes a picture mode controller 18 connected between the external video source and the timing controller 16. The picture mode controller 18 controls the timing controller 16 to display an image corresponding to a video data or a black image depending on whether the data enable signal EDE and the data clock DCLK are normally received from the external video source. When the data enable signal EDE and the data clock DCLK are normally received, the picture mode controller 18 supplies the received data enable signal EDE and data clock DCLK as an internal data enable signal IDE and an internal data clock ICLK to the timing controller 16. Thereafter, using the internal data enable signal IDE and internal data clock ICLK, the timing controller 16 displays a video image corresponding to the video data. On the other hand, when at least one of the data enable signal EDE and the data clock DCLK is not normally received, the picture mode controller 18 supplies a pseudo enable signal PDE instead of the data enable signal EDE as the internal enable signal IDE to the timing controller 16. Accordingly, the timing controller 16 displays a black image. In particular, when the data clock DCLK is normally received, the picture mode controller 18 supplies a pseudo data clock PCLK instead of the data clock DCLK together with the pseudo enable signal PDE as the internal data clock ICLK and the internal data enable signal IDE to the timing controller 16.

The picture mode controller 18 includes a first selecting unit 24 for inputting a recovered data enable signal GDE from a signal recovering unit 20 and a pseudo enable signal PDE from a pseudo enable signal generating unit 22. The signal recovering unit 20 recovers the data enable signal EDE from the external video source to the original state and supplies the recovered data enable signal GDE to the first selecting unit 24. The period of the data enable signal EDE input to the signal recovering unit 20 may be changed due to noise. The signal recovering unit 20 recovers the data enable signal EDE such that the data enable signal EDE whose period has been changed has an enable period corresponding to original resolution, and generates a recovered data enable signal GDE. The pseudo enable signal generating unit 22 generates the pseudo enable signal PDE having a constant enable period. The first selecting unit 24 supplies the recovered data enable signal GDE or the pseudo enable signal PDE as the internal data enable signal IDE to the timing controller 16. When the internal data enable signal IDE containing the recovered data enable signal GDE is supplied to the timing controller 16, the timing controller 16 controls the gate driver 12 and the data driver 14 to display a video image corresponding to the video data is on the LC panel 10. On the other hand, when the internal data enable signal IDE containing the pseudo enable signal PDE is supplied to the timing controller 16, the timing controller 16 controls the gate driver 12 and the data driver 14 to display a black image on the LC panel 10. As an alternative for displaying the black image on the LC panel 10, the timing controller 16 can turn off a backlight unit (not shown) in response to the internal data enable signal IDE containing the pseudo enable signal PDE.

The picture mode controller 18 includes a no signal detecting unit 28 connected between an abnormal clock detecting unit 26 and the first selecting unit 24. The abnormal clock detecting unit 26 detects whether the data clock DCLK from the external video source has a normal period. The period of the data clock input to the abnormal clock detecting unit 26 temporarily changes during an initial booting of the external video source or when the resolution mode of an image changes. Since the timing controller 16 cannot accurately receive video data VDi when the period of the data clock DCLK changes, the image corresponding to the video data VDi normally cannot be displayed on the LC panel 10. When the data clock DCLK has a normal period, the abnormal clock detecting unit 26 supplies the received data clock DCLK to the timing controller 16 as the internal data clock ICLK, and simultaneously, supplies a clock monitoring signal CMS having a base logic (e.g., a low logic) to the no signal detecting unit 28. On the other hand, when the data clock DCLK has a period different from the normal period, the abnormal clock detecting unit 26 supplies the pseudo data clock, instead of the data clock DCLK, to the timing controller 16 as the internal data clock ICLK, and simultaneously, supplies the clock monitoring signal CMS having a predetermined logic (e.g., a high logic) to the no signal detecting unit 28. The no signal detecting unit 28 detects whether the data enable signal EDE is input from the external video source. The no signal detecting unit 28 generates the selection control signal SMS. The selection control signal SMS controls a selecting operation of the first selecting unit 24 based on information including whether the data enable signal EDE is received and the logic value of the clock monitoring signal CMS from the abnormal clock detecting unit 26. The selection control signal SMS output from the no signal detecting unit 28 has a predetermined logic (e.g., a high logic) or constant logic when the data enable signal EDE is not received or the data clock DCLK having the abnormal period is input to the abnormal clock detecting unit 26, i.e., when the clock monitoring signal CMS has a predetermined logic. The first selecting unit 24 that responds to the selection control signal SMS having the predetermined logic supplies the pseudo enable signal PDE from the pseudo enable signal generating unit 22 to the timing controller 16 as the internal enable signal IDE. On the other hand, when the data enable signal EDE is received and, simultaneously, the data clock DCLK having the normal period are input to the abnormal clock detecting unit 26, i.e., when the clock monitoring signal CMS has a base logic, the selection control signal SMS output from the no signal detecting unit 28 has a base logic (e.g., a low logic). In response to the selection control signal SMS having a base logic, the first selecting unit 24 supplies the recovered data enable signal GDE from the signal recovering unit 20 to the timing controller 16 as the internal enable signal IDE.

As described above, the picture mode controller 18 selectively outputs timing signals such as the external data enable signal EDE and the external data clock DCLK, and the pseudo timing signal such as the pseudo enable signal PDE and the pseudo data clock PCLK based on the period change of the data clock DCLK as well as whether the data enable signal EDE is received. According to the LCD device including the picture mode controller 18, only one of the video image corresponding to video data and the black image are displayed on the LC panel depending on the reception state of timing signals. Therefore, an abnormal image is not displayed in the LCD device according to the present invention. Consequently, reliability of the picture mode controller and the LCD device having the picture mode controller according to the present invention can be improved.

Figure 2:
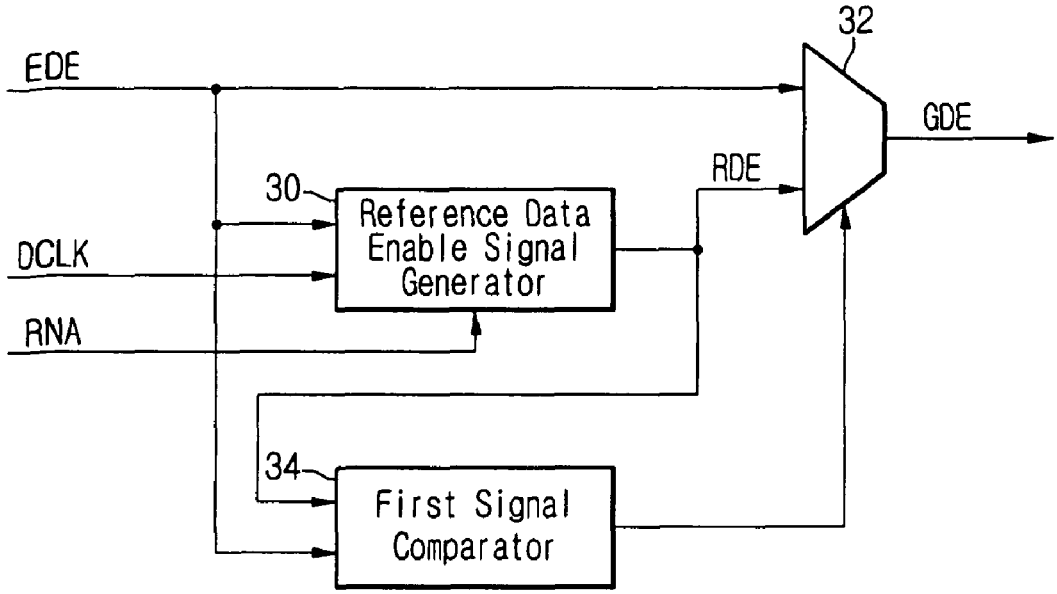
FIG. 2 is a detailed block diagram of the signal recovering unit of FIG. 1.

FIG. 2 is a detailed block diagram of the signal recovering unit 20 of FIG. 1. The signal recovering unit 20 of FIG. 2 includes a reference enable signal generator 30 for inputting the data enable signal EDE from the external video source, a second selector 32, and a first signal comparator 34. The reference enable signal generator 30 generates a reference enable signal RDE that is synchronized with the data enable signal EDE from the external video source. For this purpose, the resolution data RNA regarding resolution of the image and the data clock DCLK from the external video source are input to the reference enable signal generator 30. The resolution data RNA is generated at the external video source whenever the resolution mode of the image changes. The resolution data RNA is stored in one of the registers contained in the timing controller 16 of FIG. 1. Also, the resolution data RNA is supplied from the register of the timing controller 16 to the reference enable signal generator 30. The reference enable signal generator 30 generates the reference enable signal RDE that is synchronized with the external data enable signal EDE using the resolution data RNA and the data clock DCLK.

The second selector 32 selects one of the external data enable signal EDE from the external video source and the reference enable signal RDE from the reference enable signal generator 30. The external data enable signal EDE or the reference enable signal RDE selected by the second selector 32 is supplied as a recovered data enable signal GDE to the first selecting unit 24 of FIG. 1.

The first signal comparator 34 compares the logic value of the external data enable signal EDE with the logic value of the reference enable signal RDE in real time, and supplies a comparison signal to the second selector 32. When the logic value of the external data enable signal EDE coincides with that of the reference enable signal RDE, the first signal comparator 34 generates a comparison signal having a base logic (e.g., a low logic). The second selector 32 that responds to the comparison signal having a base logic supplies the external data enable signal EDE to the first selecting unit 32 as the recovered data enable signal GDE. On the other hand, when the logic value of the external data enable signal EDE does not coincide with that of the reference enable signal RDE, the first signal comparator 34 generates the comparison signal having the predetermined logic or constant logic. In response to the comparison signal having the predetermined logic, the second selector 32 supplies the reference enable signal RDE from the reference enable signal generator 30 to the first selecting unit 24 as the recovered data enable signal GDE.

Figure 3:
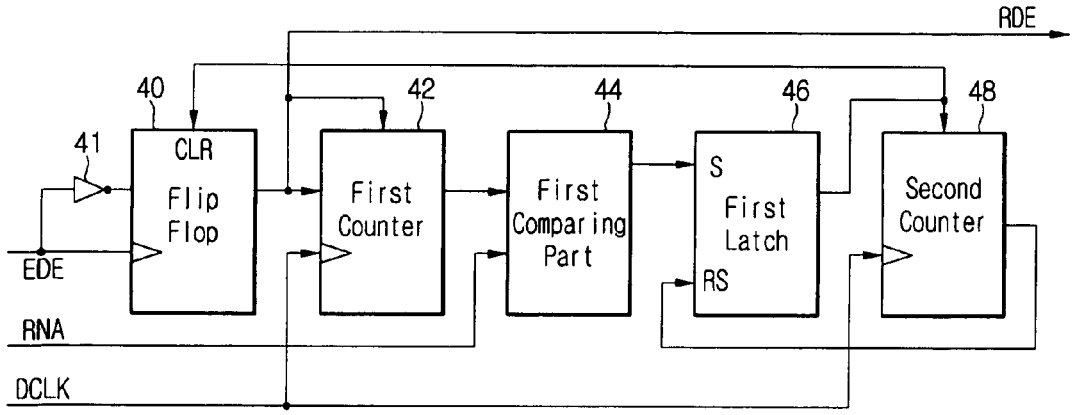
FIG. 3 is a detailed block diagram of the reference enable signal generator of FIG. 2.

FIG. 3 is a detailed block diagram of the reference enable signal generator 30 of FIG. 2. As shown in FIG. 3, the reference enable signal generator 30 includes a flip-flop 40 that responds to the external data enable signal EDE from the external video source. The flip-flop 40 latches a predetermined logic value (i.e., a high logic) of an inverted external data enable signal to an output terminal in response to a predetermined edge (e.g., a rising edge) of an external data enable signal EDE. The inverter 41 inverts the external data enable signal EDE from the external video source and supplies the inverted external data enable signal to an input terminal of the flip-flop 40. Also, the flip-flop 40 initializes the logic value in the output terminal of the flip-flop 40 in response to a latch signal of a pulse form having a predetermined logic (e.g., a high logic) that is fed back from the first latch 46. Therefore, the reference data enable signal RDE is generated at the output terminal of the flip-flop 40. An enable section, i.e., a section indicating a period during which pixel data are transmitted, of the reference data enable signal generated at the output terminal of the flip-flop 40 maintains a predetermined logic value until a pulse type latch signal having a predetermined logic is generated from the first latch 46, even when a logic value of the external data enable signal EDE changes several times, i.e., even when the external data enable signal EDE contains noises. A noise component contained in the enable section having a predetermined logic of the external data enable signal EDE is removed by the flip-flop 40. Also, a disable section, i.e., a section indicating a data suspension period, of the reference data enable signal RDE maintains a base logic until the signal reaches a predetermined edge, i.e., a rising edge, of the external data enable signal EDE after a pulse section has a predetermined logic of the latch signal. In other words, the disable section of the reference data enable signal RDE maintains at least a pulse width of the predetermined logic of the latch signal to remove a noise component that may be contained in the disable section of the external data enable signal EDE. Consequently, the flip-flop 40 generates the reference data enable signal RDE, synchronized with the external data enable signal EDE, and having a noise-free enable and disable section. The reference data enable signal generated by the flip-flop 40 is supplied to the second selector 32 of FIG. 2.

The reference data enable signal generator 30 of FIG. 3 includes a first counter 42 and a first comparing part 44 connected in series between the flipflop 40 and the first latch 46. The first counter 42 counts the time elapsing from an enable start time of the external data enable signal EDE. For this purpose, the first counter 42 performs an adding-count by "1" whenever the data clock DCLK is supplied to its clock terminal from the external video source while the reference data enable signal RDE, having the predetermined logic, is supplied from the flip-flop 40. Also, the first counter 42 is initialized and stops the counting operation while the reference data enable signal, having the base logic RDE, is supplied from the flip-flop 40. The first comparing part 44 compares the count value, i.e., an elapsing time from a data enable point, generated by the first counter 42 with the resolution data RNA from the register within the timing controller 16 of FIG. 1. When the count value from the first counter 42 is greater than the resolution data RNA, the first comparing part 44 generates the comparison signal having a predetermined logic (e.g., a high logic). Thereafter, the comparing signal having this predetermined logic pulse is applied to the set terminal of the first latch 46 to allow the latch signal from the first latch 46 to have the predetermined logic. At this point, the flip-flop 40 initializes the reference data enable signal RDE to a base logic using the latch signal by having the predetermined logic from the first latch 46 initialize the count value of the first counter 42. Accordingly, the comparison signal generated by the first comparing part 44 has a predetermined logic pulse when the enable period corresponding to the resolution of the image is counted by the first counter 42. In other words, the first comparing part 44 checks the count value from the first counter 42 and determines whether a data enable period corresponding to the resolution of the image has elapsed. Consequently, the first counter 42 and the first comparing part 44 recover the enable section of the external data enable signal EDE corresponding to the resolution of the image.

The reference enable signal generator 30 of FIG. 3 may further include a second counter 48 forming a feedback loop with the first latch 46. The first latch 46 sets an output signal on its output terminal to a predetermined logic (e.g., a high logic) in response to the comparison signal having a predetermined logic pulse supplied to its set terminal S from the first comparing part 46. Also, the first latch 46 shifts an output signal having a predetermined logic on its output terminal to a base logic (e.g., a low logic) in response to a carry signal having a predetermined logic supplied to its reset terminal RS from the second counter 48. Consequently, the first latch 46 combines the enable section having a predetermined logic with a minimum disable section having a base logic. The second counter 48 detects whether the disable period has elapsed from an end time of an enable period of a data enable signal. For this purpose, the second counter 48 counts the data clock DCLK from the external video source until the carry signal is generated in response to the latch signal having a predetermined logic from the second latch 46. When an output signal of the second latch 46 is changed into a base logic by a carry signal, the second counter 48 stops the counting operation at its initialized state. A period counted by the second counter 48 is set to be shorter than the disable section of the external data enable signal EDE. The second counter 48 may be set to generate a carry signal when a period corresponding to 80-90 of the disable section of the external data enable signal EDE is counted. Accordingly, noise can be removed from the disable section of the external data enable signal EDE.

As an alternative, the comparison signal from the first comparing part 44 can be supplied to the clear terminal CLR of the flip-flop 40 while removing the first latch 46 and the second counter 48 included in the reference data enable signal generator 30 of FIG. 3. In this case, the circuitry of the reference data enable signal generator 30 is simplified, but the reference data enable signal RDE can be influenced due to noise in the disable section of the external data enable signal EDE. As another alternative, the reference data enable signal generator 30 in FIG. 2 can be used as the signal recovering unit 20 in FIG. 1. In this case, the reference data enable signal RDE generated by the flip-flop 40 is supplied as the recovered data enable signal GDE to the first selecting unit 24 of FIG. 1.

Figure 4:
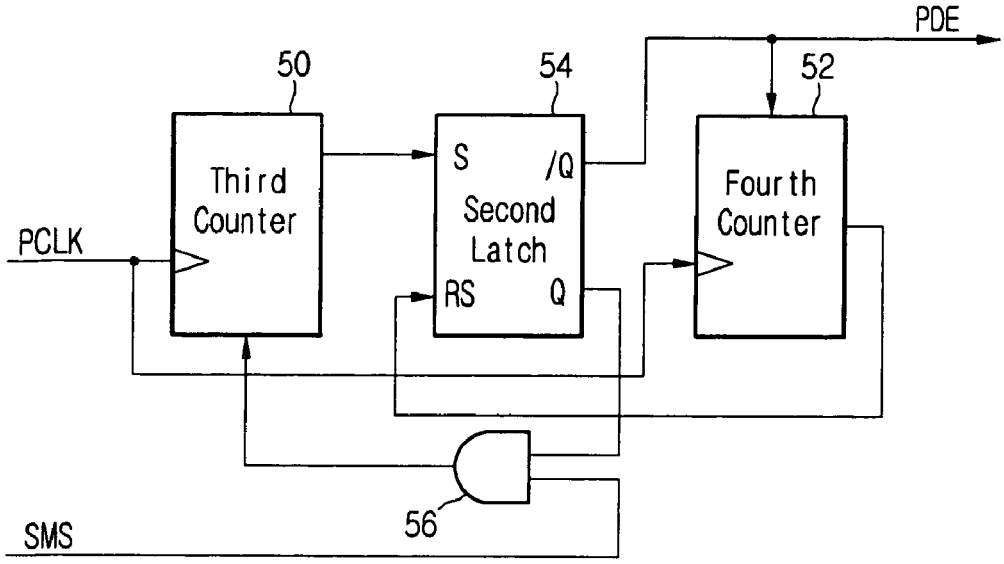
FIG. 4 is a detailed block diagram of the pseudo enable signal generating unit of FIG. 1.

FIG. 4 is a detailed block diagram of the pseudo enable signal generating unit 22 of FIG. 1. The pseudo enable signal generating unit 22 includes a third counter 50, a fourth counter 52 for counting the pseudo clock PCLK, and a second latch 54 constituting a feedback loop with the third counter 50, and simultaneously, constituting a feedback loop with the fourth counter 52.

The third counter 50 counts the number of pseudo clocks PCLK until the carry signal is generated while a predetermined logic (e.g., a high logic) of an inverted pseudo enable signal from a non-inverted output terminal Q of the second latch 54 is supplied. The carry signal generated at the third counter 50 is a pulse-typed signal, because after the third counter 50 is initialized, the inverted pseudo enable signal having a base logic (e.g., a low logic) from the non-inverted output terminal Q of the second latch 54 stops the operation. The fourth counter 52 counts the number of pseudo clocks PCLK until the carry signal is generated while a predetermined logic (e.g., a high logic) of the pseudo enable signal, from the inverted output terminal/Q of the second latch 54, is supplied. The carry signal generated at the fourth counter 52 is a pulse-typed signal, because after the fourth counter 52 is initialized, the pseudo enable signal PDE having a base logic (e.g., a low logic) from the inverted output terminal/Q of the second latch 54 stops the operation. In other words, the third counter 50 detects a point obtained by elapsing the period corresponding to the enable section after the end time of the disable section of the pseudo enable signal PDE. The fourth counter 52 detects a point obtained by elapsing the period corresponding to the disable section after the end time of the enable section of the pseudo enable signal PDE.

The second latch 54 sets its non-inverted output terminal Q to a predetermined logic (e.g., a high logic) and sets its inverted terminal/Q to a base logic (e.g., a low logic) in response to the carry signal of the third counter 50 that is supplied to the set terminal S of the second latch 54. Also, the second latch 54 initializes itself such that the non-inverted output terminal Q is set to a base logic and its inverted output terminal/Q is set to a predetermined logic in response to the carry signal from the fourth counter. Accordingly, the pseudo enable signal PDE is generated at the inverted output terminal/Q of the second latch 54, and the inverted pseudo enable signal is generated at a non-inverted output terminal Q of the second latch 54. The pseudo enable signal PDE generated at the inverted output terminal/Q of the second latch 54 is supplied to the fourth counter 52 and the first selecting unit 24. The inverted pseudo enable signal is generated at the non-inverted output terminal Q of the second latch 54 and is supplied to the third counter 50. In other Words, the second latch 54 generates the pseudo enable signal PDE on its inverted output terminal/Q using carry signals from the third and fourth counters 50 and 52. Also, the second latch 54 controls the third and fourth counters 50 and 52 such that they perform a counting operation in turns.

The pseudo enable signal generating unit 22 further includes an AND gate 56 connected between a non-inverted output terminal Q of the second latch 54 and the third counter 50. The AND gate 56 receives the selection control signal SMS having a predetermined logic (e.g., a high logic) from the no signal detecting unit 28 of FIG. 1 when the abnormal data clock DCLK is transmitted from the external video source or when the external data enable signal EDE is not received. The AND gate 56 allows a signal to be transmitted to the third counter 50 from the non-inverted output terminal Q of the second latch 54 to generate the pseudo enable signal PDE only when the selection control signal SMS from the no signal detecting unit 28 of FIG. 1 has a predetermined logic. When the selection control signal SMS maintains a base logic, i.e., when the normal data clock DCLK and the normal external data enable signal EDE are received from the external video source, the AND gate 56 blocks a signal to be transmitted from the second latch 56 to the third counter 50. Accordingly, the pseudo enable signal PDE is not generated. Consequently, the AND gate 56 allows the third counter 50, the fourth counter 52, and the second latch 54 to be selectively driven depending on a logic state of the selection control signal SMS to control the generation of the pseudo enable signal PDE.

An output signal from the AND gate 56 may be supplied to the fourth counter 52 instead of the third counter 50. In this case, the AND gate 56 performs an AND-operation on a signal on the non-inverted output terminal Q of the second latch 54 and the selection control signal SMS to control generation of the pseudo enable signal PDE. Also, the AND gate 56 may be replaced by a switch for control, or logic elements (e.g., a three state buffer, an OR-gate, a NOR-gate, and a NAND gate) capable of performing the function of a switch for control.

Figure 5:
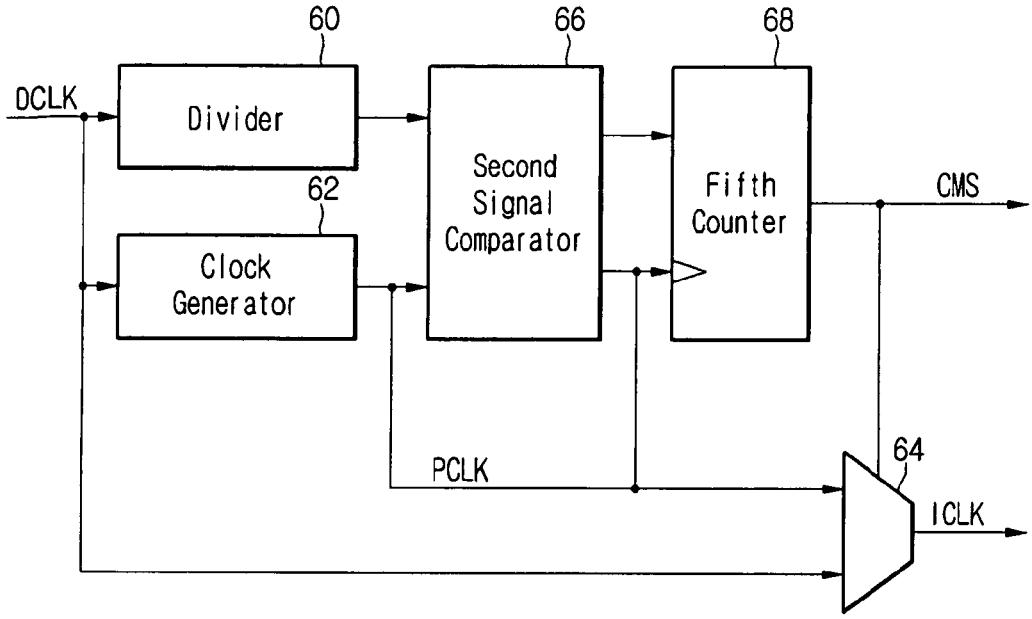
FIG. 5 is a detailed block diagram of the abnormal clock detecting unit of FIG. 1.

FIG. 5 is a detailed block diagram of the abnormal clock detecting unit 26 of FIG. 1. As shown in FIG. 5, the abnormal clock detecting unit 26 includes a clock generator 62 for generating the pseudo clock PCLK, a divider 60 for receiving the data clock DCLK from the external video source, and a third selector 64. The pseudo clock PCLK generated at the clock generator 62 has a frequency that depends on the resolution of the image. For this purpose, the clock generator 62 can be operated under control of the timing controller 16 of FIG. 1. The pseudo clock PCLK generated at the clock generator 62 is supplied to the second signal comparator 66, and simultaneously, supplied to the third and fourth counters 50 and 52 of FIG. 4. (not shown)

The divider 60 divides the frequency of the data clock DCLK from the external video source in a predetermined dividing ratio. The data clock divided by the divider 60 is supplied to the second signal comparator 66. As an alternative, a dividing ratio of the divider 60 can be changed depending on the resolution of the image controlled by the timing controller 16. In this case, the frequency of the pseudo clock PCLK generated at the clock generator 62 is fixed to a constant value.

The second signal comparator 66 compares the period of a divided data clock with that of the pseudo clock PCLK. When the period of the divided data clock is the same as that of the pseudo clock PCLK, the second signal comparator 66 generates the comparison signal having a base logic (e.g., a low logic). On the other hand, when the period of the divided data clock is different from that of the pseudo clock PCLK, the comparison signal output from the second signal comparator 66 has a predetermined logic (e.g., a high logic). Even when the frequency of the data clock DCLK changes, i.e., the resolution of the image changes, the comparison signal of the second signal comparator 66 has a predetermined logic. In other words, the second signal comparator 66 maintains the predetermined logic while the abnormal data clock DCLK, different from the resolution of the image, is received.

A fifth counter 68 selectively performs a counting operation in response to the comparison signal of the second signal comparator 66. When the comparison signal from the second signal comparator 66 maintains a base logic, the fifth counter 68 stops an operation at a state where a count value has been initialized. On the other hand, when the comparison signal from the second signal comparator 66 maintains a predetermined logic, i.e., while the abnormal data clock DCLK is received, the fifth counter 68 counts the number of pseudo clocks PCLK from the clock generator 62 until the carry signal having a predetermined logic is generated to detect that the abnormal data clock DCLK is constantly received for a predetermined time. The carry signal of the fifth counter 68 is supplied as the clock monitoring signal CMS to the third selector 64 and the no signal detecting unit 28 of FIG. 1. The fifth counter 68, counting a reception period of the data clock DCLK, performs a temporal detection of the abnormal data clock DCLK that may be excluded. In other words, the fifth counter 68 removes an influence of a noise that may be contained in the data clock DCLK. In another exemplary embodiment, the abnormal clock detecting unit 26 can be simplified by removing the fifth counter 68 from the circuit. In this case, the comparison signal generated at the second signal comparator 66 is supplied, as the clock monitoring signal CMS, to the third selector 64 and the no signal detecting unit 28 of FIG. 1.

The third selector 64 selectively supplies the data clock DCLK from the external video source and the pseudo clock PCLK from the clock generator 62 to the timing controller 16 of FIG. 1 in response to the clock monitoring signal CMS from the fifth counter 68. When the clock monitoring signal CMS has a base logic, i.e., when the normal data clock DCLK is received, the third selector 64 supplies the external data clock DCLK as the internal data clock ICLK to the timing controller 16. On the other hand, when the clock monitoring signal CMS has a predetermined logic, i.e., when the abnormal data clock DCLK is received for a predetermined time or more, the third selector 64 supplies the pseudo clock PCLK from the clock generator 62 as the internal data clock ICLK to the timing controller 16.

Figure 6:
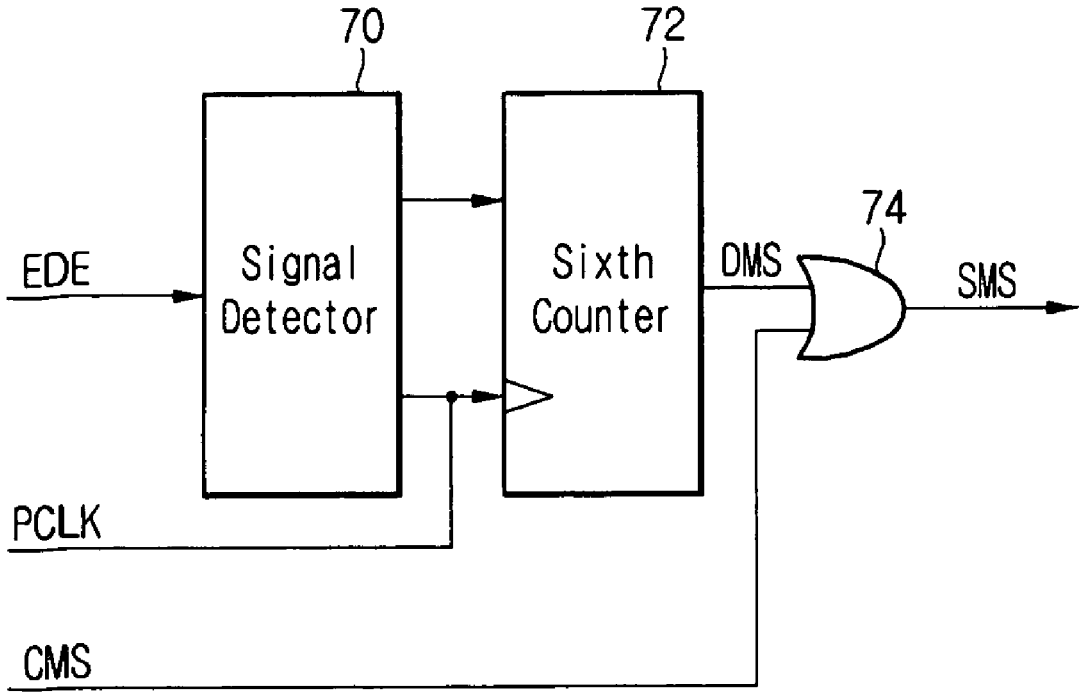
FIG. 6 is a detailed block diagram of a no signal detecting unit of FIG. 1.

FIG. 6 is a detailed block diagram of the no signal detecting unit 28 of FIG. 1. As shown in FIG. 6, the no signal detecting unit 28 includes a signal detector 70 for receiving the external data enable signal EDE from the external video source, a sixth counter 72, and an OR-gate 74 connected in series. The signal detector 70 detects whether the external data enable signal EDE from the external video source is received. When the external data enable signal EDE is received, the signal detector 70 generates a detecting signal having a base logic (e.g., a low logic). On the other hand, when the external data enable signal EDE is not received, the signal detector 70 generates a detecting signal having a predetermined logic (e.g., a high logic). To detect whether the external data enable signal EDE has been received, the signal detector 70 may include an integrating part for integrating the external data signal EDE, and a comparing part for comparing an output of the integrating part and outputting the comparison result as a detection signal.

The sixth counter 72 selectively performs a counting operation in response to the detection signal from the signal detector 70. When the detection signal from the signal detector 70 maintains a base logic, the sixth counter 72 stops the counting operation at a state where a count value has been initialized. On the other hand, when the detection signal from the signal detector 70 maintains a predetermined logic, i.e., while a data enable signal EDE is not received, the sixth counter 72 counts the number of pseudo clocks PCLK from the clock generator 62 until the carry signal, having a predetermined logic, is generated to detect whether the external data enable signal EDE is not constantly received for a predetermined time. The carry signal of the sixth counter 72 is supplied as the data enable monitoring signal DMS to the OR gate 74. The sixth counter 72 counting a non-reception period of the data enable signal EDE allows a non-reception state of the external data enable signal EDE, in which noise can be removed. In other words, the sixth counter 72 removes an influence of noise that may be contained in the data enable signal EDE. In another exemplary embodiment, the no signal detecting unit 28 can be simplified by removing the sixth counter 72 from the circuit. In this case, the detection signal generated by the signal detector 70 is directly supplied to the OR gate 74 as the data enable monitoring signal DMS.

The OR gate 74 performs an OR-operation on the data enable monitoring signal DMS from the sixth counter 72 and the clock monitoring signal CMS from the abnormal clock detecting unit 26 of FIG. 1, i.e., the fifth counter 68 of FIG. 5, to generate the selection signal SMS. The selection signal SMS generated by the OR gate 74 has a predetermined logic (e.g., a high logic) when the external data enable signal EDE is received constantly for at least a predetermined time and when the abnormal data clock DCLK is received constantly for at least a predetermined time. When the external data enable signal EDE is received and a normal data clock DCLK is received, the OR gate 74 generates the selection signal SMS having a base logic. This selection signal is supplied to the first selecting unit 24 of FIG. 1, and the pseudo enable signal generating unit 22, i.e., the AND gate 56 of FIG. 4.

As described above, the picture mode controller for the flat panel display device according to the present invention allows received timing signals such as the external data enable signal EDE and the external data clock DCLK, and pseudo timing signals such as the pseudo enable signal PDE and the pseudo data clock PCLK to be switched based on a period change of the data clock DCLK as well as whether the data enable signal is received. Since the received timing signals and the pseudo timing signals are output in a mutually exclusive manner, the display mode of video data corresponding to video data and the display mode of a black image can alternate without any temporal overlap.

As the received timing signal designating displaying of the video image and the pseudo timing signal designating displaying of the block image are accurately switched, the LCD device according to the present invention can display only one of the video image corresponding to video data and a block image on an LC panel in turns. Therefore, according to an LCD device of the present invention, an abnormal image is not displayed. Consequently, reliability of the picture mode controller and an LCD device including the same can be improved.

It will be apparent to those skilled in the art that various modifications and variations can be made in the picture mode controller for flat panel and flat panel display device including the same of the present invention without departing from the spirit or scope of the invention. Thus, it is intended that the present invention cover the modifications and variations of this invention provided they come within the scope of the appended claims and their equivalents.

What is claimed is:

1. A picture mode controller comprising:

an input unit to input a data enable signal indicating transmission sections for pixel data, and a clock signal indicating a transmission time of each pixel data;

a signal recovering unit for recovering the data enable signal to be comprise an enable period corresponding to original resolution and generating a recovered data enable signal;

a pseudo enable signal generating unit to generate a pseudo data enable signal to be used as the data enable signal;

a first selecting unit to selectively output the recovered data enable signal and the pseudo data enable signal to allow one of a video picture mode and a black picture mode to be designated; and a selection control unit to control a selecting operation of the first selecting unit based on whether the data enable signal is input from the input unit and whether a period of the clock signal changes, wherein the selection control unit controls the first selecting unit to output the recovered data enable signal when the data enable signal is received and the clock signal maintains a constant period, wherein the selection control unit comprises a no signal detector to detect whether the data enable signal is received from the input unit and an abnormal signal detector to detect whether a period of the clock signal changes, and supply a detecting results to the first selecting unit, wherein the no signal detector includes a logic element for performing an OR operation on signals output from the no signal detector and the abnormal signal detector.

2. The controller according to claim 1, wherein the abnormal signal detector comprises:

a pseudo clock signal generating part to generate a pseudo clock signal corresponding to the clock signal; and a second signal comparing part to compare the clock signal with the pseudo clock signal, and to supply a clock monitoring signal having a different logic value depending on the comparison result to the first selecting unit.

3. The controller according to claim 2, wherein the clock monitoring signal has a predetermined logic when the period of the clock signal does not coincide with the period of the pseudo clock signal, and the clock monitoring signal has a base logic when the period of the clock signal coincides with the period of the pseudo clock signal.

4. The controller according to claim 3, wherein the abnormal signal detector further comprises a fifth time counter to allow the clock monitoring signal to have the predetermined logic when the period of the clock signal is different from the period of the pseudo clock signal for at least a predetermined time continuously.

5. The controller according to claim 4, wherein the fifth time counter counts the predetermined time using the pseudo clock signal.

6. The controller according to claim 4, wherein the abnormal signal detector further comprises a third selecting part to selectively output the clock signal and the pseudo clock signal in response to a logic value of the clock monitoring signal of the fifth time counter.

7. The controller according to claim 2, wherein the abnormal signal detector further comprises a divider to divide a frequency of the clock signal and to supply the divided frequency to the second signal comparing part.

8. The controller according to claim 7, wherein at least one of a frequency dividing ratio of the divider and an oscillating frequency of the pseudo clock signal generating part changes depending on resolution of an image.

9. The controller according to claim 1, wherein the signal recovering unit comprises:

a reference data enable signal generator for generating a reference data enable signal synchronized with the data enable signal;

a second selector part for selecting one of the data enable signal and the reference data enable signal; and a signal comparator for comparing a logic value of the data enable signal with a logic value of the reference data enable signal in real time, and supplying a comparison signal to the second selector part.

10. The controller according to claim 9, wherein the reference data enable signal generator comprises a flip-flop to latch a predetermined logic value of an inverted data enable signal to an output terminal in response to a predetermined edge of the data enable signal, an inverter to invert the data enable signal and supply the inverted date enable signal to an input terminal of the flip-flop and a first latch, wherein the flip-flop initializes the logic value in the output terminal of the flip-flop in response to a latch signal of a pulse form having a predetermined logic that is fed back from the first latch.

11. The controller according to claim 10, wherein the reference data enable signal generator further comprises:

a first time counter and a first comparing part connected in series between the flip-flop and the first latch, wherein the first time counter counts the time elapsing from an enable start time of the data enable signal and, is initialized and stops the counting operation while the reference enable data signal is supplied from the flip-flop, wherein the first comparing part compares the count value generated by the first counter with a resolution data from the timing controller and generate a comparing signal corresponding to the comparison results, and supply the comparing signal to the first latch.

12. The controller according to claim 11, wherein the reference data enable signal generator further comprises a second time counter for forming a feedback loop with the first latch and detecting whether a disable period has elapsed from an end time of an enable period of the data enable signal, wherein the first latch set a signal to be supplied to the flip-flop in response to a predetermined logic of a signal output from the first time counter, and then reset a signal to be supplied to the flip-flop in response to a predetermined logic of a signal output from the second time counter.

13. The controller according to claim 12, wherein the first time counter performs a counting operation in response to the reference data enable signal from the flip-flop, and the second time counter performs a counting operation in response to a signal output from the latch.

14. The controller according to claim 1, wherein the pseudo timing signal generating unit comprises:

a third time counter to detect a point obtained by elapsing the period corresponding to a enable section after the end time of a disable section of the pseudo data enable signal;

a fourth time counter to detect a point obtained by elapsing the period corresponding to a disable section after the end time of a enable section of the pseudo date enable signal; and a second latch constituting a feedback loop with the third time counter, and simultaneously, constituting a feedback loop with the fourth time counter.

15. The controller according to claim 14, wherein the pseudo timing signal generating unit further comprises a AND gate connected between the second latch and the third time counter and to receive the selection control signal having a predetermined logic from the no signal detecting unit.

16. A flat panel display device comprising:

a flat panel;

a light source for providing a light to the flat panel;

a driving circuit to drive the flat panel;

a timing controller to control the driving circuit and the light source;

an input unit to input a pixel data stream, a data enable signal indicating transmission sections for pixel data, and a clock signal indicating a transmission time of each pixel data;

a driving circuit to drive the flat panel using the pixel data stream, the data enable signal, and the clock signal to display an image corresponding to the pixel data stream;

a pseudo timing signal generating unit to generate a pseudo data enable signal corresponding to the data enable signal;

a selecting unit to selectively supply a recovered data enable signal from the input unit and the pseudo data enable signal to the driving circuit to selectively display a video image corresponding to a video data stream and a black image on the flat panel;

a selection control unit to control a selecting operation of the selecting unit based on whether the data enable signal is input from the input unit and whether a period of the clock signal changes; and a signal recovering unit to recover the data enable signal to be supplied from the input unit to the selecting unit, wherein the timing controller turn off the light source when the pseudo data enable signal is supplied to the timing controller as a internal data enable signal, wherein the selection control unit comprises a no signal detector to detect whether the data enable signal is received from the input unit and an abnormal signal detector to detect whether a period of the clock signal changes, and supply a detecting results to the first selecting unit, wherein the no signal detector includes a logic element for performing an OR operation on signals output from the no signal detector and the abnormal signal detector.

17. The flat panel display device according to claim 16, wherein the flat panel comprises a liquid crystal panel.

18. A method for driving a flat panel display device having a flat panel, a light source for providing a light to the flat panel, a driving circuit to drive the flat panel, a timing controller to control the driving circuit and the light source, an input unit to input a pixel data stream, a data enable signal indicating transmission sections for pixel data, and a clock signal indicating a transmission time of each pixel data, the data enable signal, and the clock signal to display an image corresponding to the pixel data stream, and a pseudo data enable signal generating unit to generate a pseudo data enable signal corresponding to the data enable signal, the method comprising:

recovering a waveform of the data enable signal to be supplied from the input unit to the controller;

detecting whether the data enable signal is received from the input unit;

detecting whether a period of the clock signal from the input unit changes; and selectively supplying the recovered data enable signal and the pseudo data enable signal to the driving circuit depending on whether the signal is received and the period of the clock signal changes, and selectively displaying a video image corresponding to a video data stream and a black image on the flat panel, wherein the timing controller turn off the light source when the pseudo data enable signal is supplied to the timing controller as a internal data enable signal, wherein the selectively supplying of the data enable signal and the pseudo recovered data enable signal comprises supplying the data enable signal to the timing controller to display the video image on the flat panel when the data enable signal is received and the clock signal maintains a constant period.

* * * * *